US008985219B2

(12) United States Patent
Cruden

(10) Patent No.: US 8,985,219 B2
(45) Date of Patent: Mar. 24, 2015

(54) SYSTEM AND METHOD FOR CONNECTION AND INSTALLATION OF UNDERWATER LINES

(75) Inventor: Keith David Cruden, Singapore (SG)

(73) Assignee: OneSubsea, LLC, Houston, TX (US)

( * ) Notice: Subject to any disclaimer, the term of this patent is extended or adjusted under 35 U.S.C. 154(b) by 123 days.

(21) Appl. No.: 13/273,249

(22) Filed: Oct. 14, 2011

(65) Prior Publication Data

US 2012/0168168 A1 Jul. 5, 2012

Related U.S. Application Data

(60) Provisional application No. 61/415,948, filed on Nov. 22, 2010.

(51) Int. Cl.
*E21B 29/12* (2006.01)
*E21B 33/038* (2006.01)
*E21B 43/013* (2006.01)

(52) U.S. Cl.
CPC ..... *E21B 33/038* (2013.01); *E21B 43/013* (2013.01)
USPC ..... 166/340; 166/338; 166/360; 166/341; 166/343

(58) Field of Classification Search
USPC ..... 166/338–345, 360, 368; 285/19, 26
See application file for complete search history.

(56) References Cited

U.S. PATENT DOCUMENTS 3,840,071 A * 10/1974 Baugh et al. ..... 166/338
4,453,566 A 6/1984 Henderson, Jr. et al.
4,607,815 A * 8/1986 Turci et al. ..... 244/172.4
4,682,913 A 7/1987 Shatto et al.
5,013,178 A 5/1991 Baker et al.
5,265,980 A 11/1993 Lugo et al.
5,295,848 A 3/1994 Mohn
5,333,691 A 8/1994 Dean et al.
5,593,249 A 1/1997 Cox et al.
5,730,551 A * 3/1998 Skeels et al. ..... 405/170
5,794,701 A 8/1998 Cunningham et al.
6,234,717 B1 5/2001 Corbetta
6,471,250 B2 10/2002 Smith, III
6,503,021 B2 * 1/2003 Corbetta ..... 405/170
6,902,199 B2 6/2005 Colyer et al.
7,083,201 B2 8/2006 Smith, III
7,165,619 B2 1/2007 Fox et al.
7,219,932 B2 5/2007 Smith, III
7,243,729 B2 7/2007 Tyrrell et al.
7,311,035 B2 12/2007 Reynolds
7,467,662 B2 12/2008 Smith (Continued)

FOREIGN PATENT DOCUMENTS

GB 2196081 4/1988
GB 2271621 4/1994
WO 2006/044763 4/2006

*Primary Examiner* — James G Sayre
(74) *Attorney, Agent, or Firm* — Chamberlain Hrdlicka

(57) ABSTRACT

A technique facilitates formation of subsea connections. A free portion of a stab plate connection system is moved into proximity with a fixed portion of the stab plate connection system at a subsea location. The free portion is initially engaged with the fixed portion via a docking probe. Subsequently, a local actuator is used to draw the free portion into an operating engagement with the fixed portion in which line couplers of the fixed portion are engaged with corresponding line couplers of the free portion.

17 Claims, 4 Drawing Sheets

(56) References Cited

U.S. PATENT DOCUMENTS

| | | | | |
|---|---|---|---|---|
| 2003/0168857 | A1* | 9/2003 | Jennings | 285/322 |
| 2008/0073904 | A1* | 3/2008 | Changalpet | 285/26 |
| 2008/0143100 | A1* | 6/2008 | Webster | 285/18 |
| 2010/0038090 | A1* | 2/2010 | Barratt et al. | 166/343 |
| 2010/0155073 | A1* | 6/2010 | Blank et al. | 166/338 |
| 2010/0170678 | A1* | 7/2010 | Marlow et al. | 166/360 |
| 2010/0200240 | A1* | 8/2010 | Biester | 166/338 |
| 2011/0088909 | A1* | 4/2011 | Hamblin et al. | 166/340 |

* cited by examiner

SYSTEM AND METHOD FOR CONNECTION AND INSTALLATION OF UNDERWATER LINES

CROSS-REFERENCE TO RELATED APPLICATIONS

This application is a non-provisional application of co-pending U.S. Provisional Patent Application 61/415,948, filed 22 Nov. 2010, the content of which is incorporated herein by reference for all purposes.

BACKGROUND

In many subsea oil and gas well applications, flying leads and stab plates are employed to connect hydraulic hoses and electrical cables between subsea production equipment, such as subsea trees and manifolds. The connections are formed with the assistance of a remotely operated vehicle (ROV). The flying lead generally comprises a length of umbilical having copper conductors, optical fibers and/or hoses which can range in length from a few meters to 200 or more meters. The flying lead may have a stab plate at one or both of its ends to serve as the interface between the umbilical and the structures where the lines, e.g. electrical, optical fiber and/or hydraulic, are terminated.

Stab plates typically are formed with a stainless steel plate and a population of hydraulic and electrical couplers/connectors. A stab plate also may comprise a locking mechanism, a termination bracket for holding the flying lead umbilical, and an ROV bracket. An ROV is employed to deliver the stab plate to a desired subsea location while gripping the ROV bracket. Once at the desired subsea connection location, the ROV is again employed to use a torque tool for connecting the stab plate to a corresponding stab plate, thus forming the subsea stab plate connection.

In many applications, ROVs are used to fly and lock the leads at the desired stab plate connection via an available tool system, such as a tool deployment unit (TDU) or a flying lead orientation tool (FLOT). Each of these types of systems uses a torque tool for locking down one stab plate to a corresponding stab plate, which can result in a complex and time-consuming procedure for forming the subsea connection. Further difficulties may arise in forming a successful subsea connection because existing stab plates can weigh in excess of 100 kg and sometimes in excess of 200 kg without including the weight of the umbilical. Operation of the ROV in performing these complex connection procedures with relatively heavy stab plates creates many difficulties, e.g. large loads acting on the components being connected. As a result, such operations require highly skilled ROV pilots. In some applications, additional difficulties arise from the time required for ROV integration with respect to the corresponding tooling and for calibration of the tools used by the ROV.

SUMMARY

In general, the present invention provides a technique which facilitates formation of a subsea connection. The technique comprises moving a free portion of a stab plate connection system into proximity with a fixed portion of the stab plate connection system at a subsea location. At the subsea location, the free portion is initially engaged with the fixed portion via an engagement mechanism, such as a docking probe. Subsequently, a local actuator is used to draw the free portion into an operating engagement with the fixed portion so that line couplers of the fixed portion are engaged with corresponding line couplers of the free portion. In some applications, the stab plate connection system also may comprise an ejection mechanism which may be selectively operated to disconnect and eject the free portion.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for forming a subsea lead connection in which a plurality of lines, e.g. electrical, fiber-optic, and/or hydraulic lines, may be connected to subsea equipment. A stab plate connection system is provided and generally comprises a fixed portion or plate and a free portion or plate which may be selectively moved to a desired subsea location and connected with the fixed portion.

The design of the stab plate connection system enables construction of the free portion as a lightweight stab plate of, for example, less than 50 kg. The design also facilitates movement of the lightweight stab plate to substantial depth, e.g. 3000 m or more, via an ROV. Additionally, the free portion/lightweight stab plate may be installed without requiring the use of ROV installation tooling. For example, the free portion may be connected and disconnected from the fixed portion using a subsea control system or an ROV hot stab. Consequently, the installation process is much simpler for the ROV pilot when connecting, for example, large numbers of electrical and hydraulic lines for intervention on live wells from dynamically positioned vessels. The system also may comprise a unique emergency disconnect feature which allows the free portion to be ejected and reconnected, if required, without the need for recovering the free portion to a surface location for re-termination or refurbishment. The ability to immediately reinstall the free portion after ejection from the fixed portion facilitates use of this design with surface dynamically positioned vessels.

According to at least one embodiment, the free portion has a very simple design utilizing a junction box and couplers. The design enables a deck crew to change or maintain couplers, e.g. hydraulic and electric connectors, from a position above the plate when laid flat on a surface deck. In this embodiment, the work can be performed without damaging the lines or couplers because the couplers are fully protected within a syntactic foam body. This type of buoyancy designed body helps keep the in-water weight to a minimum and also helps protect the junction box and couplers from impact forces.

Figure 1:
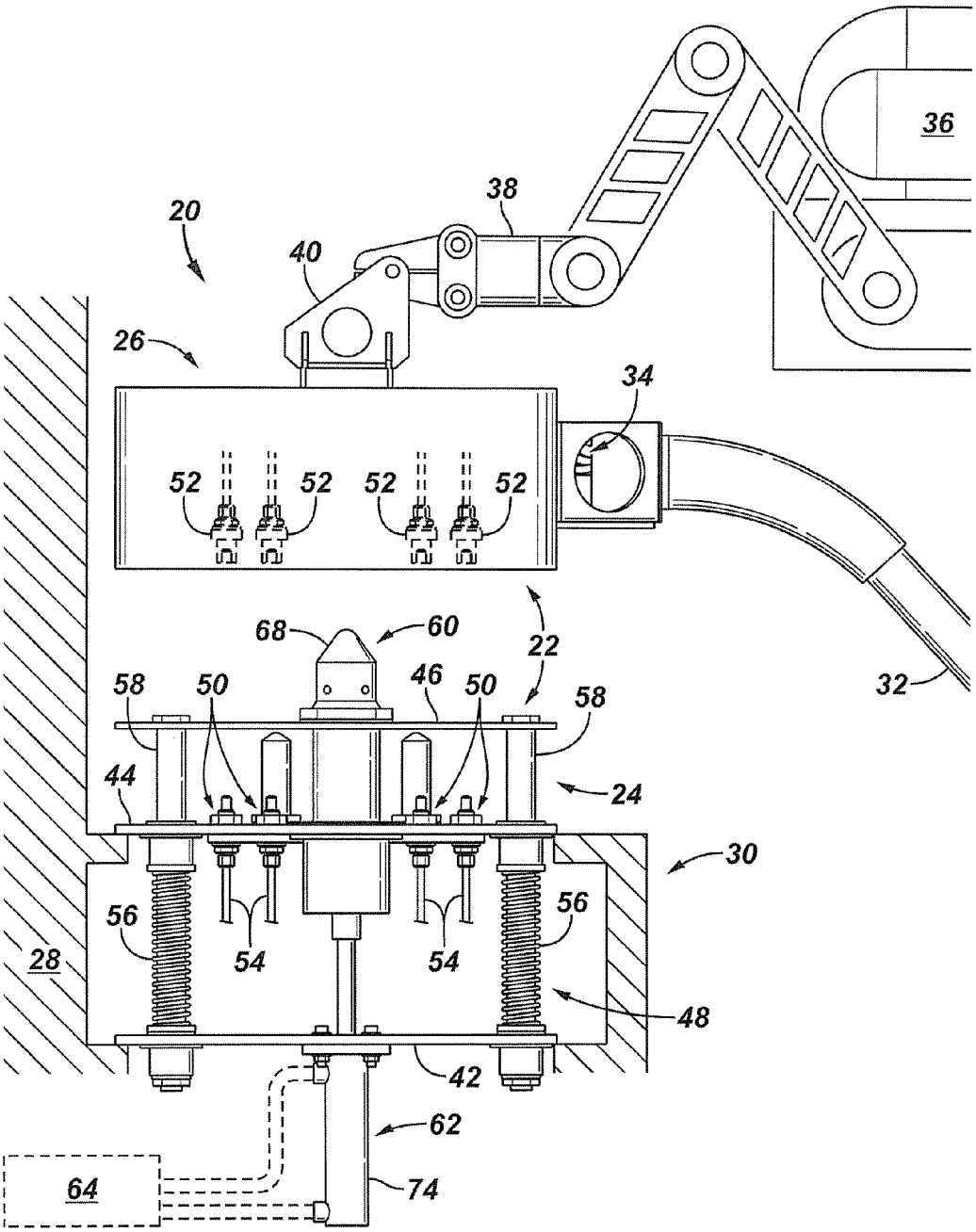
FIG. 1 is an illustration of a free portion of a stab plate connection system being moved toward a fixed portion of the stab plate connection system, according to an embodiment of the present invention.

Referring generally to FIG. 1, an embodiment of a subsea system 20 is illustrated as having a stab plate connection system 22. The stab plate connection system 22 comprises a fixed plate or portion 24 and a free plate or portion 26 which may be engaged with the fixed portion 24 to provide a subsea lead connection which couples control lines to a variety of subsea equipment. The fixed portion 24 is part of or affixed to a subsea installation 28 positioned at a subsea location 30. The free portion 26 is coupled to an umbilical 32 having a plurality of lines 34, such as hydraulic lines, electrical lines, and/or fiber optic lines. When a connection is to be formed at the subsea location 30, the free portion 26 is moved to the subsea location by a suitable device, such as a remotely operated vehicle (ROV) 36.

In FIG. 1, free portion 26 is illustrated as being delivered by ROV 36 for engagement with the fixed portion 24. The ROV 36 requires no special tooling for making the connection between free portion 26 and fixed portion 24 but simply grabs the free portion 26 with an ROV manipulator arm 38. For example, free portion 26 may comprise an ROV bracket or handle 40 which is simply grabbed by arm 38 for transport of free portion 26 to fixed portion 24 at the subsea location 30.

In the embodiment illustrated, fixed portion 24 comprises a lower plate member 42 and a middle plate member 44 secured to subsea installation 28. The fixed portion 24 also comprises an upper plate 46 which is illustrated as a part of an ejector mechanism 48. The upper plate 46 is movable to facilitate engagement of control line couplers 50 of fixed portion 24 with corresponding control line couplers 52 of free portion 26. Ejector mechanism 48 also is designed to selectively move upper plate 46 in a manner which ejects free portion 26 from fixed portion 24, as discussed in greater detail below. It should be noted that corresponding couplers 52 terminate the various control lines 34, and couplers 50 provide corresponding terminations of control lines 54 which are routed from fixed portion 24 to various subsea equipment, as desired for a given subsea application. Couplers 50 and corresponding couplers 52 may comprise a variety of connection devices for connecting electrical, optical fiber, hydraulic, and/or other types of control lines.

In the specific example illustrated, ejector mechanism 48 may comprise a spring biased ejector mechanism having one or more springs 56 oriented to bias upper plate 46 to the position illustrated in FIG. 1. By way of example, a plurality of springs 56 may be located around telescoping rods or members 58 extending from lower plate member 42 to upper movable plate 46. The springs 56 bias the rods 58 toward the extended position illustrated.

The stab plate connection system 22 further comprises an engagement mechanism 60 which may be selectively positioned to extend beyond movable plate 46 to facilitate easy, preliminary engagement with free portion 26. The engagement mechanism 60 cooperates with an actuator 62 which may be in the form of a hydraulic actuator mounted to fixed portion 26, e.g. mounted to lower plate 42. By way of example, actuator 62 is controlled by a subsea control system 64 and/or an ROV standard hot stab 66, as illustrated in FIG. 2.

Figure 2:
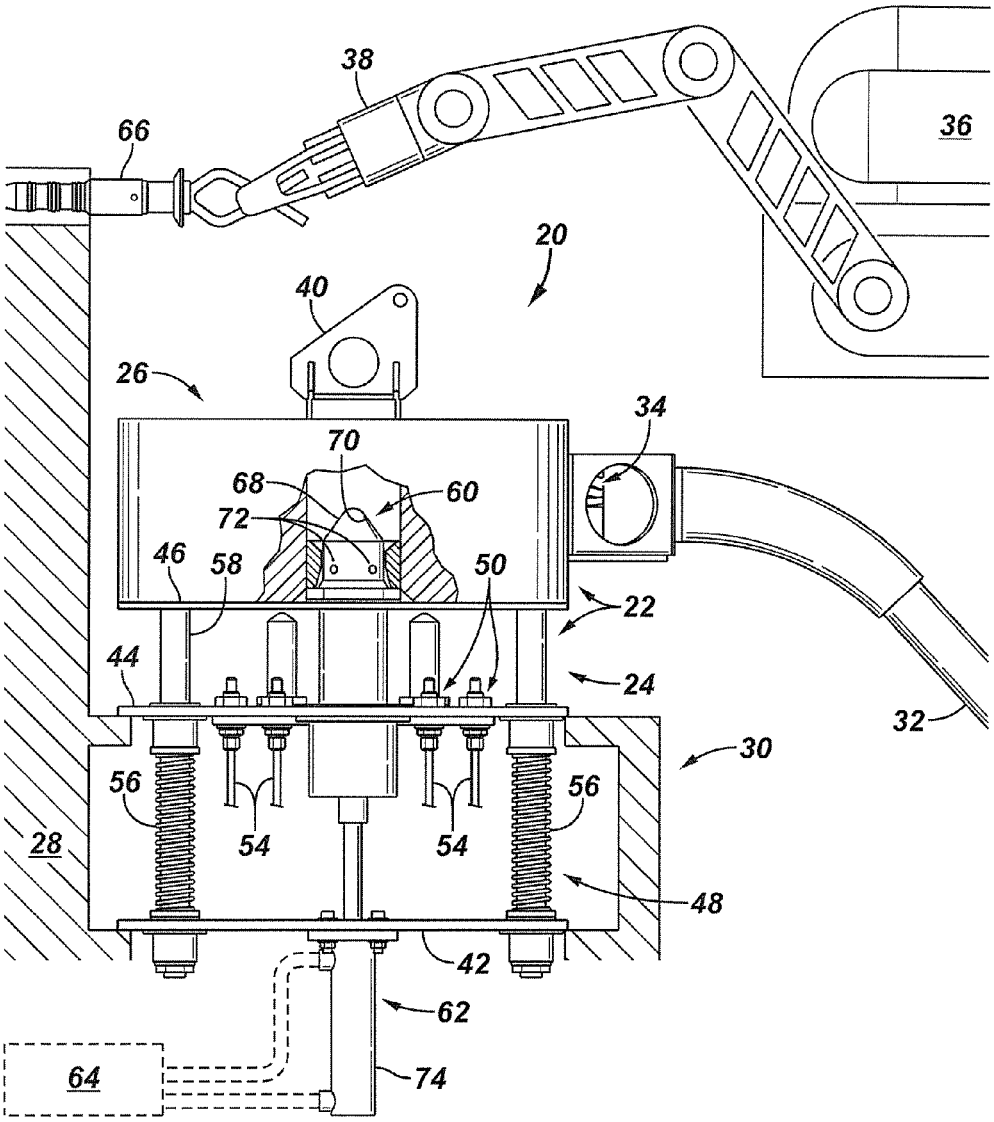
FIG. 2 is an illustration similar to that of FIG. 1 but with the free portion positioned in a preliminary engagement with the fixed portion, according to an embodiment of the present invention.

In FIG. 2, the free portion 26 has been released, e.g. dropped, onto the engagement mechanism 60 to establish a preliminary engagement between fixed portion 24 and free portion 26. The engagement mechanism 60 allows the ROV 36 to release the free portion 26 before the free portion 26 is fully engaged with the fixed portion 24, i.e. before couplers 50 are engaged with corresponding couplers 52. This greatly simplifies the ROV pilot operations because no additional ROV tools, e.g. torquing tools, are required. Engagement mechanism 60 may be designed to simplify the installation of free portion 26 by providing a tapered shape 68 which cooperates with a corresponding tapered recess 70 in free portion 26. The tapered shape 68 and corresponding tapered recess 70 also may be designed with features, e.g. eccentrics or complementary portions, to properly orient the free portion 26 with respect to the fixed portion 24 when the free portion 26 is dropped onto engagement mechanism 60.

By way of example, engagement mechanism 60 may comprise at least one docking probe, such as an individual ISO 13628-8 standard docking probe. The engagement mechanism 60 also may cooperate with a latch 72 operated via a variety of mechanisms, such as an internal hydraulic cylinder connected to latch fingers. In some applications, the latches have internal springs which allow the fingers to retract if there is a loss of hydraulic pressure; however other applications are designed to work without such spring-loaded fingers. In one example, hydraulics used to operate actuator 62 are also plumbed to latch mechanism 72 to allow the latch mechanism 72 and actuator 62 to latch and then retract in sequence using the same hydraulic function. The hydraulic function may be operated and controlled by one or both of the subsea control system 64 and the standard hot stab connection 66.

Figure 3:
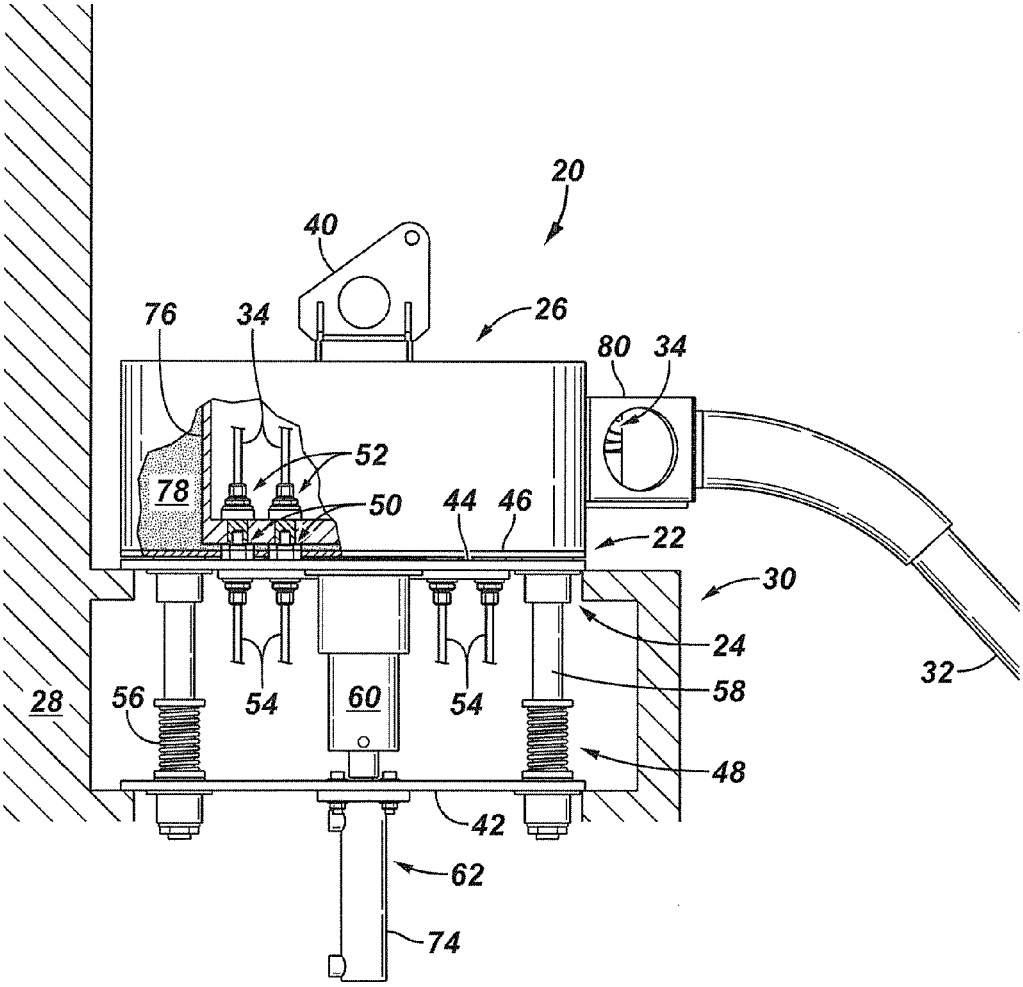
FIG. 3 is an illustration similar to that of FIG. 2 but with the free portion drawn into full engagement with the fixed portion in which line couplers of the fixed portion are engaged with corresponding line couplers of the free portion, according to an embodiment of the present invention.

Actuator 62 is designed to selectively draw free portion 26 into full operational engagement with fixed portion 24, as illustrated in FIG. 3. For example, actuator 62 may be designed with a hydraulic cylinder 74 which is activated via control system 64 and/or hot stab connection 66 to retract engagement mechanism 60 and draw movable plate 46 and free portion 26 toward middle plate member 44. It should be noted that other types of actuators, e.g. electrical actuators, also may be employed to control the movement and engagement of free portion 26 with fixed portion 24. The actuator 62 draws corresponding couplers 52 into engagement with couplers 50 of fixed portion 24 to form the subsea connection with control lines 34 of umbilical 32.

As illustrated, the connection mechanism, e.g. actuator 62 and engagement mechanism 60, is local to and connected into the fixed portion 24, thus eliminating the need for carrying a torque tool or installation tooling on the ROV. For example, FLOT and TDU systems may be avoided. As a result, many hours of installation time are saved by avoiding ROV set up time otherwise required for procedures such as torque tool mounting, adjustment and calibration. The design also reduces the vessel time otherwise required to form stab plate connections. Actuator 62 and engagement mechanism 60 also enable the stab plate connection system 22 to be oriented at a variety of angles ranging between horizontal and vertical. For example, the free portion 26 may be moved into engagement with fixed portion 24 along a line forming an angle greater than 0 degrees with respect to a line normal to the sea floor.

To facilitate proper engagement of couplers 50 with corresponding couplers 52, middle plate member 44 may be constructed as a floating plate. In other words, the middle plate member 44 may float to adjust itself within predetermined tolerances of the system, thus preventing any misalignment between couplers 50 and corresponding couplers 52 when connecting electrical lines, hydraulic lines, fiber optic lines, or other types of control lines 34. Similarly, the couplers 50 may be mounted to middle plate member 44 as floating couplers with predetermined tolerances that also help ensure proper line connections. As illustrated, the middle plate member 44 may be used to securely mount the docking probe or other engagement mechanism 60. The design and arrangement enables a substantially greater number of electrical, fiber optic, and/or hydraulic lines to be connected compared with conventional stab plates. For example, 10×12 way connections (or greater) may be formed due to the design of and controlled engagement of fixed portion 24 and free portion 26.

Referring again to FIG. 3, the free portion 26 may be in the form of a stab plate comprising multiple corresponding couplers 52 which serve as terminations for service control lines 34. The couplers 52 and lines 34 may be hydraulic, electrical, optical fiber, or various combinations of control lines. By way of example, the corresponding couplers 52 may comprise female couplers designed for engagement with male couplers 50 or vice versa. In this embodiment, the corresponding couplers 52 are mounted on a termination junction box 76 protected by a syntactic buoyancy portion 78, such as a buoyant syntactic foam body. The umbilical 32 may be terminated either in the junction box or distributed to the various corresponding couplers 52 via a bracket bend restrictor 80. The termination junction box 76 may be filled with oil and pressure compensated against ambient pressure. Additionally, the overall free portion 26 may be shaped for easy ROV flying and easy engagement with the docking probe or other engagement mechanism 60.

Use of junction box 76 enables, for example, termination of multiple electrical and/or optical fiber cables by mounting the junction box on the free portion 26, which is formed as a stab plate. The multiple control line connectors are bulkheaded to the junction box. This allows the free portion 26 to be constructed as a subsea multi-plug, and the umbilical 32 may be constructed as a much smaller, molded tether. In other words, the junction box serves as an umbilical termination junction box coupled to a molded cable umbilical 32. The smaller, molded tether not only reduces weight but also reduces stiffness and facilitates installation. In some embodiments, the junction box may be designed for electrical and/or optical fiber lines and used in combination with hydraulic lines and couplers mounted external to the junction box 76.

Figure 4:
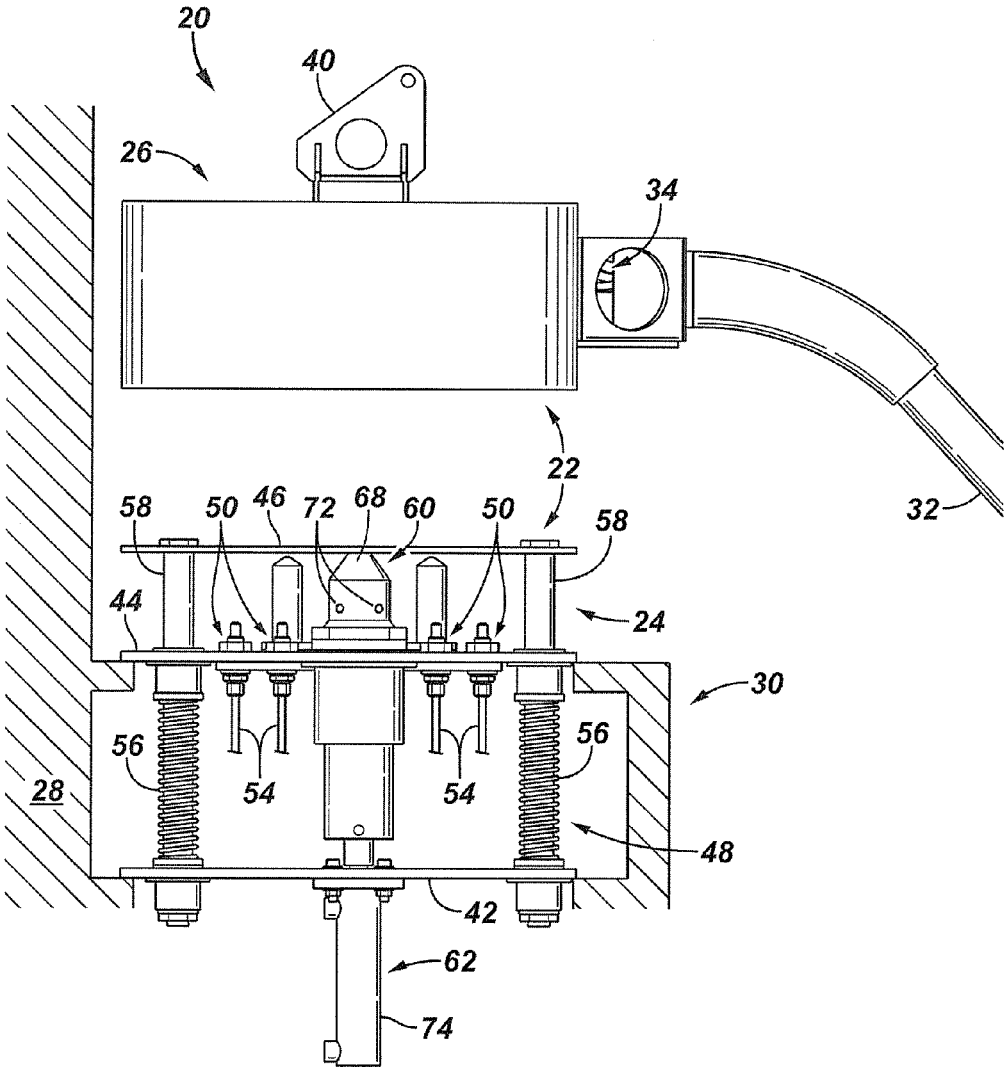
FIG. 4 is an illustration of the free portion being ejected from the fixed portion, according to an embodiment of the present invention.

The stab plate connection system 22 also employs the ejector mechanism 48 to facilitate separation and the potential re-engagement of free portion 26 and fixed portion 24. In the embodiment illustrated, ejector mechanism 48 employs the upper plate member 46 as an ejector plate which is spring-loaded against springs 56 when the corresponding couplers 52 are drawn into engagement with couplers 50 via actuator 62. The actuator 62 may be selectively actuated to release latch mechanism 72, thus enabling springs 56 to eject free portion 26 from fixed portion 24, as illustrated in FIG. 4. In other applications, the actuator 62 may be designed to selectively move plate 46 in an opposite direction to eject free portion 26 with or without the assistance of springs 56.

In some applications and environments, ejection mechanism 48 may be used in certain emergency situations. For example, the ejection mechanism 48 may be employed when the free portion umbilical 32 is in the form of a tether extending from a surface, dynamically positioned vessel and a "run-off" occurs. The design of ejector mechanism 48 allows a suitable control system, e.g. the subsea control system 64 and/or the control provided via ROV hot stab 66, to disconnect the free portion 26 from the fixed portion 24 under controlled circumstances, e.g. to release latch mechanism 72 via actuator 62 or separate hydraulic plumbing. In other words, the disconnection is accomplished without breaking threaded connections or other traditional types of connections that would require recovery of the components to a surface location for refurbishment.

The disconnect and ejection mechanism 48 also may be designed to protect couplers 50 on fixed portion 24 from damage when free portion 26 is initially dropped or placed onto engagement mechanism 60. The movable plate member 46 and engagement mechanism 60, e.g. docking probe, prevents any clashing between free portion 26 and couplers 50. Once free portion 26 is positioned on engagement mechanism 60, the full engagement of couplers 50 with corresponding couplers 52 is achieved through controlled movement via actuator 62. In some applications, the movement of free portion 26 into full engagement with fixed portion 24 is completely visible to the ROV. Additionally, any slight misalignment between couplers 50 and corresponding couplers 52 may be eliminated with the floating middle plate member 44.

Although ejection mechanism 48 may be constructed in a variety of forms, the illustrated embodiment employs a plurality of the guide rods 58 which are equally spaced, spring-loaded, and independent of the one or more engagement mechanisms 60. When engagement mechanism 60 is retracted via actuator 62, latching mechanism 72 secures free portion 26 and both movable plate member 46 and free portion 26 are drawn to middle plate member 44. This motion compresses springs 56 and effectively loads the ejector mechanism 48. The movement is continued by actuator 62 until the couplers 50 are fully engaged with corresponding couplers 52 and the stab plate connection system is fully connected. The movable plate 46 remains sandwiched between free portion 26 and the middle plate member 44 until the ejection sequence is initiated.

If ejection of the free portion 26 is desired, an appropriate control signal is sent to actuator 62 which releases latch mechanism 72. (It should be noted separate actuators may be used to control latch mechanism 72) In the illustrated embodiment, the plurality of springs 56 has enough stored energy to separate the couplers 50 and corresponding couplers 52 and to force free portion 26 away from fixed portion 24, as illustrated in FIG. 4. However, the free portion 26 is immediately available for re-engagement with engagement mechanism 60 so that actuator 62 can draw the free portion 26 into full engagement with the fixed portion 24. As described above, the ejection is achieved without breaking any fasteners or other components that would require recovery to the surface for refurbishment.

Depending on the specifics of the subsea application and environment, the slab plate connection system and methodology may be employed with a variety of subsea equipment types for many subsea applications. The shape and hydrodynamics of the free portion 26 may be adjusted to facilitate flying of the free portion as it is moved through water to the desired subsea location. The specific type of docking probe(s) or other engagement mechanism may be adjusted according to the parameters of the subsea application and available equipment. Additionally, the types of control systems, actuators, ejection mechanisms, couplers, and other components may be changed or adjusted for specific applications and/or environments. Similarly, the number and arrangement of control lines and couplers, e.g. connectors, may vary substantially depending on the specific subsea operation undertaken. As a result, the size and type of the umbilical is selected according to the parameters of the application.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of forming a subsea lead connection, comprising:

moving a free portion of a stab plate connection system into proximity with a fixed portion of the stab plate connection system at a subsea location;

engaging the free portion and the fixed portion via a docking probe;

operating an actuator on the fixed portion to draw the free portion into an operating engagement in which line couplers of the fixed portion are engaged with corresponding line couplers of the free portion; and further comprising selectively disconnecting and separating the free portion from the fixed portion via an ejection mechanism.

2. The method as recited in claim 1, further comprising engaging the free portion with the fixed portion after separation without recovery of the free portion to a surface location.

3. The method as recited in claim 1, wherein moving comprises moving the free portion to the subsea location with a remotely operated vehicle (ROV).

4. The method as recited in claim 1, wherein moving comprises moving the free portion in a form that weighs less than 50 kg.

5. The method as recited in claim 1, further comprising forming the free portion with a body having a syntactic buoyancy portion.

6. The method as recited in claim 1, wherein engaging comprises latching the free portion to the docking probe.

7. The method as recited in claim 1, further comprising forming the free portion with an umbilical termination junction box coupled to a molded cable.

8. The method as recited in claim 1, wherein operating comprises engaging both electrical couplers and hydraulic couplers.

9. The method as recited in claim 1, further comprising orienting the stab plate connection system for connection along a line forming a greater than 0° angle with a line normal to the sea floor.

10. The method as recited in claim 1, wherein selectively disconnecting and separating comprises employing a spring-loaded mechanism on the fixed portion to actively separate the free portion away from the fixed portion.

11. A method, comprising:

employing an ROV to move a free portion of a stab plate connection system onto a docking probe of a fixed portion positioned at a subsea location;

releasing the ROV from the free portion;

after releasing the ROV, drawing the free portion into further engagement with the fixed portion; and setting a disconnect eject mechanism of the stab plate connection system; and further comprising selectively disconnecting and separating the free portion from the fixed portion and subsequently fully engaging the free portion and the fixed portion without recovery of the free portion to a surface location.

12. The method as recited in claim 11, wherein drawing comprises engaging line couplers of the fixed portion with corresponding line couplers of the free portion.

13. The method as recited in claim 12, wherein drawing comprises retracting the docking probe.

14. The method as recited in claim 11, wherein setting comprises setting a spring-loaded mechanism during drawing of the free portion into further engagement with the fixed portion.

15. A system, comprising:

a fixed portion of a stab plate connection system, the fixed portion having a plurality of line couplers; and a free portion of the stab plate connection system, the free portion having a plurality of corresponding line couplers and an ROV handle to enable delivery to the fixed plate via an ROV;

wherein an engagement mechanism of the fixed portion is oriented to enable preliminary engagement of the free portion with the fixed portion upon delivery via the ROV; and wherein a local actuator is permanently coupled to the stab plate connection system to move the free portion and to draw the plurality of corresponding line couplers into engagement with the plurality of line couplers and further comprising a disconnect ejection mechanism to selectively disconnect and separate the free portion from the fixed portion without causing damage requiring recovery to a surface location.

16. The system as recited in claim 15, wherein the plurality of line couplers and corresponding line couplers are designed to connect a plurality of electrical and hydraulic lines.

17. The system as recited in claim 15, wherein the disconnect ejection mechanism comprises a plurality of springs operatively coupled to an ejector plate.

* * * * *